US011666959B2

(12) United States Patent
Schmolke

(10) Patent No.: US 11,666,959 B2
(45) Date of Patent: Jun. 6, 2023

(54) FORMING TOOL AND METHOD FOR PRODUCING A COMPONENT

(71) Applicant: Bayerische Motoren Werke Aktiengesellschaft, Munich (DE)

(72) Inventor: Thomas Schmolke, Bodenkirchen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/968,455

(22) PCT Filed: Feb. 25, 2019

(86) PCT No.: PCT/EP2019/054519
§ 371 (c)(1),
(2) Date: Aug. 7, 2020

(87) PCT Pub. No.: WO2019/174893
PCT Pub. Date: Sep. 19, 2019

(65) Prior Publication Data

US 2020/0398330 A1 Dec. 24, 2020

(30) Foreign Application Priority Data

Mar. 15, 2018 (DE) ..... 10 2018 203 987.9

(51) Int. Cl.

| | |
|---|---|
| ***B21D 26/047*** | (2011.01) |
| ***B21D 37/10*** | (2006.01) |
| ***B21D 26/031*** | (2011.01) |
| ***B21D 37/08*** | (2006.01) |
| ***B21D 45/04*** | (2006.01) |
| ***B21D 22/06*** | (2006.01) |

(52) U.S. Cl.
CPC ..... *B21D 26/047* (2013.01); *B21D 37/10* (2013.01); *B21D 26/031* (2013.01); *B21D 37/08* (2013.01); *B21D 45/04* (2013.01)

(58) Field of Classification Search
CPC .... B21D 26/047; B21D 26/031; B21D 37/10; B21D 37/08; B21D 45/04; B21D 22/06; B21D 26/025; B21D 26/31; B21D 26/039; B21D 45/00; B21D 45/02
USPC ..... 72/344, 345
See application file for complete search history.

(56) References Cited

U.S. PATENT DOCUMENTS

2007/0017267 A1 1/2007 Wagner et al.

FOREIGN PATENT DOCUMENTS

| | | | |
|---|---|---|---|
| CN | 2691726 Y | | 4/2005 |
| CN | 201357193 Y | * | 12/2009 |
| CN | 201357193 Y | | 12/2009 |
| CN | 202169331 U | | 3/2012 |
| CN | 103747891 A | | 4/2014 |

(Continued)

OTHER PUBLICATIONS

English translate (CN107008797A), retrieved date Nov. 2, 2021.*

(Continued)

*Primary Examiner* — Matthew Katcoff
*Assistant Examiner* — Mohammed S. Alawadi
(74) *Attorney, Agent, or Firm* — Crowell & Moring LLP

(57) ABSTRACT

A forming tool includes at least one first die half where the first die half has an insert part which is designed to move a finished component out of the first die half along a direction of motion where a displacement direction of the insert part is inclined relative to the direction of motion.

8 Claims, 1 Drawing Sheet

(56) References Cited

FOREIGN PATENT DOCUMENTS

| | | | | | |
|---|---|---|---|---|---|
| CN | 104308058 | A | | 1/2015 | |
| CN | 105013919 | A | | 11/2015 | |
| CN | 106862393 | A | * | 6/2017 | |
| CN | 107008797 | A | * | 8/2017 | |
| CN | 107008797 | A | | 8/2017 | |
| DE | 103 50147 | A1 | | 6/2005 | |
| DE | 10 2013 183 612 | A1 | | 10/2014 | |
| EP | 1 029 611 | A2 | | 8/2000 | |
| EP | 1 088 607 | A1 | | 4/2001 | |
| EP | 1 442 806 | A1 | | 8/2004 | |
| GB | 2354730 | A | * | 4/2001 | ..... B21D 26/029 |
| JP | 2005-324219 | A | | 11/2005 | |
| KR | 10-2011-0063142 | A | | 6/2011 | |

OTHER PUBLICATIONS

English translate (CN201357193Y), Retrieved date Mar. 1, 2022.*
English translate(CN106862393A), retrieved date Aug. 26, 2022.*
English-language Chinese Office Action issued in Chinese application No. 201980008490.0 dated Jul. 5, 2021 (Nine (9) pages).
PCT/EP2019/054519, International Search Report dated Jul. 5, 2019 (Two (2) pages).
German-language German Office Action issued in German application No. 10 2018 203 987.9 dated Dec. 27, 2018 (Five (5) pages).
English-language Chinese Office Action issued in Chinese application No. 201980008490.0 dated Feb. 14, 2022 (Eleven (11) pages).
English-language Chinese Office Action issued in Chinese application No. 201980008490.0 dated Jan. 19, 2023 (Eight (8) pages).

* cited by examiner

FORMING TOOL AND METHOD FOR PRODUCING A COMPONENT

BACKGROUND AND SUMMARY OF THE INVENTION

The present invention relates to a forming tool, in particular for tensile and compressive forming, such as hydroforming, to a method for producing a component and also to a use of a tool.

In forming processes, such as for example in hydroforming, materials are converted specifically into a different shape. For this purpose, depending on the process, use is made of appropriate tools. The high pressures and forces which are active here make it necessary, inter alia, for the finished components to be removed from the tools. As far as the design of the components, and also of the tools, is concerned, attention is therefore given to the presence of demolding slopes in the closing direction of the tools, in order for it to be possible for the static friction to be reduced to a minimum and for the component to be removed from the tool as far as possible in a non-destructive manner. In the case of the component having the surfaces which are plane-parallel in relation to the closing direction, it may be the case that the static friction is so high that it is no longer possible for the components to be removed manually or in an automated manner, for example using a robot. However, the introduction of demolding slopes restricts the design freedom in respect of the design of the components. In addition, the provision of such demolding slopes may not even be possible at some locations.

It is therefore an object of the present invention to specify a forming tool, a method for producing a component, and also a use of a tool, which eliminate the aforementioned disadvantages and make it possible for the finished components to be easily removed from the corresponding forming tools.

According to the invention, a forming tool, in particular for tensile and compressive forming, such as for example hydroforming, comprises at least one first die half, wherein the first die half has or comprises an insert part, which is designed to displace a finished component out of the first die half along a movement direction, and wherein a displacement direction of the insert part is inclined or oriented obliquely in relation to the movement direction of the component at least to some extent. The insert part expediently performs two functions. As a first function, it forms, to some extent, an outer contour of the subsequent component, that is to say it is a constituent part of the die half or continues the contour of the latter. In addition, it is designed to function as an ejector, which can be displaced in relation to the first die half in order to displace the finished component in relation to the first die half. During this displacement, the component moves, inter alia also in dependence on the geometry of the tool and/or of the first die half, along the movement direction. The great advantage, then, is that the displacement direction of the insert part is directed away from the movement direction at least to some extent. In other words, the insert part moves away from the component at least to some extent, which brings with it the advantage that the component can be removed from the insert part in a force-free manner, or without force being applied. In an end position of the insert part, the component therefore merely rests on the insert part. As a result, it is also possible to manufacture components with undercuts, at least in the region of the insert part. The reduced friction during the removal operation advantageously also reduces the tool wear. According to one embodiment, the insert part is operated for example hydraulically. The corresponding hydraulics can be dimensioned to be considerably smaller than has usually been the case up until now, since the amount of force applied is smaller as a result of the inclined displacement direction.

According to one embodiment, the tool comprises the first die half and a second die half, which can be closed along a closing direction such that it is possible to form a cavity for a component, and wherein the displacement direction, at least to some extent, is inclined in relation to the closing direction and is oriented away from the cavity. As already outlined previously, the insert part therefore also moves perpendicularly to the closing direction, as a result of which the component is completely freed as it is being lifted out of the first die half. For the purpose of closing the tool, there is no need for both die halves to be displaced. It is sufficient if for example the second die half is displaced in the direction of the first die half, or vice versa. To this extent, it is possible for each die half, or even for just one die half, to have a closing direction which is oriented in each case in the direction of the other die half.

According to one embodiment, the second die half is an upper tool half and the first die half is a lower tool half, wherein the tool is a hydroforming tool. The insert part is advantageously provided in the lower die half. It is also possible for the tool to comprise more than two tool halves. The term "half" should therefore not be taken literally.

According to one embodiment, the tool comprises an ejector unit, wherein the ejector unit has two insert parts, and wherein the displacement directions of the insert parts are oriented away from one another at least to some extent. The ejector unit is expediently designed in the form of a split lifting device or ejector. According to one embodiment, the aforementioned split runs vertically along a center plane of the cavity. In a closed position of the tool, the two insert parts are in contact with one another in the region of the center plane. When the tool is being opened, and the insert parts are being displaced, the latter part or move away from one another, on account of the different displacement directions, and a gap forms.

The tool expediently comprises a multiplicity of ejector units or a multiplicity of split lifting devices/ejectors. The multiplicity of ejector units are expediently arranged along the cavity or along a longitudinal direction of the component or of the cavity. According to one embodiment, the component is, for example, an elongate structural component of a vehicle body or of a vehicle frame, such as for example of a motor vehicle or of a motorcycle. According to one embodiment, for example three ejector units are provided in the first die half or in the lower tool half.

According to a preferred embodiment, the displacement directions are inclined at an angle ranging from approximately 0.545° in relation to the closing direction and/or the movement direction of the component. The actual implementation or configuration is dependent, inter alia, on the component geometry and/or the procedure.

According to one embodiment, the insert part is mounted via a prestressing element, or the insert parts are mounted via prestressing elements. According to one embodiment, the prestressing elements are gas pressure springs. When the tool is being opened, the gas pressure springs push the insert parts or the insert part upward and to the side along the displacement direction(s), that is to say away from the cavity and/or from the component. The amount of travel executed here is dependent, in particular, on the component or tool dimensions and can range from a few millimeters to a few centimeters.

According to one embodiment, the insert part is designed such that it is prestressed, in particular automatically, as the tool is being closed. It is expediently the case that for example the aforementioned gas pressure springs are prestressed as the tool is being closed. If the tool opens, the stressed gas pressure springs push the split lifting devices upward and to the side along the displacement direction(s).

According to the invention, a method for producing a component comprises the following steps:

producing a component using a forming process in a tool, wherein the tool has at least one first die half with at least one insert part;

opening the tool and ejecting the component along a movement direction by means of the insert part;

displacing the insert part along a displacement direction, which is inclined in relation to the movement direction of the component.

The advantages and features mentioned in conjunction with the tool also apply in an analogous and corresponding manner to the method, and vice versa. Positioning the displacement direction(s) obliquely in relation to the movement direction of the component makes it possible for the component to be removed from the insert part or, if more than one is used, from the insert parts more or less in a force-free manner. The removal operation can take place here, for example, by hand or also in an automated manner, for example by means of a robot or the like. As already mentioned in conjunction with the tool, the process used is advantageously a hydroforming one. A lower half of the tool here advantageously has, for example, three ejector units, each comprising two insert parts. When the tool opens, the component is ejected via the ejector units and displaced in relation to the lower tool half. In an end position of the ejector units, the component then merely rests on the ejector units or the insert parts and can be easily removed.

The invention is also directed to a use of a tool according to the invention for producing vehicle components, in particular hydroformed components. The advantages and features mentioned in conjunction with the tool and the method also apply in an analogous and corresponding manner to the use.

Further advantages and features can be gathered from the following description of an embodiment of a tool with reference to the accompanying Figures.

DETAILED DESCRIPTION OF THE DRAWINGS

Figure 1:
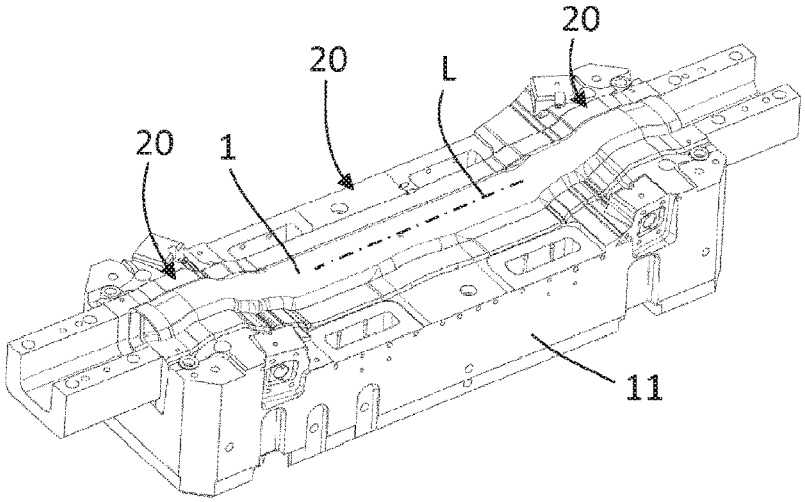
FIG. 1 shows a perspective view of a lower tool half of a hydroforming tool with a component arranged therein.

FIG. 1 shows a perspective illustration of a tool, in particular a hydroforming tool. This is merely a partial illustration. It shows, in particular, just a lower tool half 11 or a lower die half, in which is arranged a component 1, which extends along a longitudinal direction L. A component is essentially a hollow body, which extends along the longitudinal direction L. Ejector units 20 are provided at the locations or positions denoted by reference sign 20 and each of these ejector units comprise two insert parts, reference being made in this respect to FIG. 2.

Figure 2:
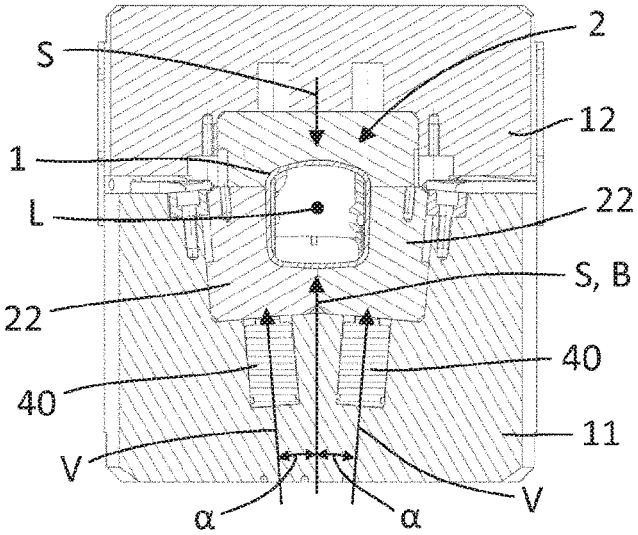
FIG. 2 shows a sectional view of the arrangement shown in FIG. 1 prior to insert parts being moved out.

FIG. 2 shows a sectional illustration at least of part of the tool which is known from FIG. 1, this view also illustrating a second or upper die half 12. The section is taken along the region of an ejector unit, and it is therefore possible to see the corresponding insert parts 22 here. In particular, it can be seen that the ejector unit is a split lifting device or ejector. These are part of the die and form, to some extent, an outer contour of the component 1, which extends along the longitudinal direction L. In this view, the tool is closed. For this purpose, the first or lower die half 11 and the second or upper die half 12 have been displaced along their respective closing directions S. As an alternative, it is also possible for just one of the die halves 11 or 12 to be displaced. The insert parts 22 are arranged or mounted in the lower die half 11 via prestressing elements 40. The reference sign B denotes a movement direction of the component 1. When the insert parts 22 are moved out or displaced along their respective displacement direction V, the component 1 moves along the movement direction B and/or along the closing direction S of the second or upper die half 12. To this extent, this gives rise to an angle $\alpha$ between the displacement directions V and the movement direction B of the component 1 and/or the corresponding closing direction, the angle $\alpha$, depending on the component geometry, ranging for example from approximately 0.5-45°.

Figure 3:
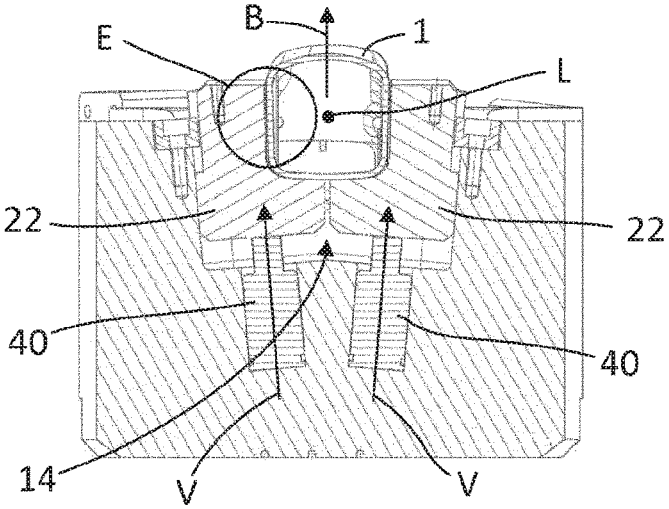
FIG. 3 shows the arrangement which is known essentially from FIG. 2, the insert parts being depicted in an end position.

FIG. 3, then, shows essentially the arrangement which is known from FIG. 2, although the upper die half 12 has not been illustrated here. The ejectors or insert parts 22 have been moved out to the full extent and it can be seen that a gap 14 has formed between them. Furthermore, the insert parts 22 have also moved away from the side walls of the component 1, cf., by way of example, the detail E. It is advantageously possible to do without demolding slopes in these regions. If appropriate, even undercuts are possible. As a result, the component 1 can be removed from the tool more or less in a force-free manner. The prestressing elements 40 are, for example, gas pressure springs, which were prestressed for example as the tool was being closed and then move out automatically when the tool is being opened.

LIST OF REFERENCE CHARACTERS

1 Component
2 Cavity
11 First/lower die half/tool half
12 Second/upper die half/tool half
14 Gap
20 Ejector unit
22 Insert part, ejector
40 Prestressing element
$\alpha$ Angle
B Movement direction
E Detail
S Closing direction
V Displacement direction

What is claimed is:

1. A forming tool, comprising:

a first die half; and an insert part, wherein at least a portion of an outer contour of a finished component is formable by the insert part and wherein the finished component is displaceable out of the first die half along a movement direction by the insert part;

wherein a displacement direction of the insert part is inclined in relation to the movement direction;

wherein the insert part comprises a portion of an ejector unit, wherein the ejector unit has two insert parts, and wherein respective displacement directions of the insert parts are oriented away from one another at least to an extent;

wherein each of the two insert parts has a lower portion that is disposed under the finished component both when the forming tool is closed and when the forming tool is open and wherein the respective lower portions are disposed adjacent to one another at a vertical center plane of a cavity defined by the forming tool and in which cavity the finished component is disposed.

2. The forming tool according to claim 1 further comprising a second die half which is closable along a closing direction to form a cavity in the forming tool;

wherein the displacement direction, at least to an extent, is inclined in relation to the closing direction and is oriented away from the cavity.

3. The forming tool according to claim 2, wherein the second die half is an upper tool half of the forming tool and the first die half is a lower tool half of the forming tool and wherein the forming tool is a hydroforming tool.

4. The forming tool according to claim 2, wherein the displacement direction is inclined at an angle ranging from 0.5° to 45° in relation to the closing direction and/or the movement direction.

5. The forming tool according to claim 1 further comprising a plurality of ejector units.

6. The forming tool according to claim 1, wherein the insert part is mounted in the first die half via a prestressing element.

7. The forming tool according to claim 1, wherein the insert part is configured such that the insert part is prestressed as the forming tool is being closed.

8. A method for producing a component, comprising the acts of:

producing the component in a forming tool, wherein the forming tool has a first die half with an insert part, wherein at least a portion of an outer contour of the produced component is formed by the insert part;

opening the forming tool and displacing the insert part along a displacement direction which is inclined in relation to a movement direction of the produced component; and ejecting the produced component from the forming tool along the movement direction by the displacing of the insert part;

wherein the insert part comprises a portion of an ejector unit, wherein the ejector unit has two insert parts, and wherein respective displacement directions of the insert parts are oriented away from one another at least to an extent;

wherein each of the two insert parts has a lower portion that is disposed under the finished component both when the forming tool is closed and when the forming tool is open and wherein the respective lower portions are disposed adjacent to one another at a vertical center plane of a cavity defined by the forming tool and in which cavity the component is disposed.

* * * * *